US010062234B2

(12) United States Patent
Bayne et al.

(10) Patent No.: US 10,062,234 B2
(45) Date of Patent: Aug. 28, 2018

(54) SYSTEM FOR REGULATING ACCESS TO A RESOURCE

(75) Inventors: Christopher Bayne, Oxford (GB); Christopher Butler, Nr. Henley-on-Thames (GB); Leonard Sim, Wokingham (GB)

(73) Assignee: LO-Q, PLC, Henley-on-Thames (GB)

( * ) Notice: Subject to any disclaimer, the term of this patent is extended or adjusted under 35 U.S.C. 154(b) by 1460 days.

(21) Appl. No.: 12/778,369

(22) Filed: May 12, 2010

(65) Prior Publication Data

US 2010/0277276 A1 Nov. 4, 2010

Related U.S. Application Data

(63) Continuation-in-part of application No. 12/291,745, filed on Nov. 12, 2008, now Pat. No. 8,779,889.

(51) Int. Cl.

| | |
|---|---|
| ***G07C 9/02*** | (2006.01) |
| *G07C 9/00* | (2006.01) |
| *G07C 11/00* | (2006.01) |

(52) U.S. Cl.

CPC ..... *G07C 9/02* (2013.01); *G07C 9/00111* (2013.01); *G07C 9/00103* (2013.01);

(Continued)

(58) Field of Classification Search

CPC ..... G07C 9/02; G07C 2011/02

(Continued)

(56) References Cited

U.S. PATENT DOCUMENTS 5,502,806 A * 3/1996 Mahoney et al. ..... 715/839
6,529,786 B1 * 3/2003 Sim ..... 700/90

(Continued)

FOREIGN PATENT DOCUMENTS

EP 1324248 A2 7/2003
JP 2000163485 6/2000

(Continued)

OTHER PUBLICATIONS

Office Action from Japanese related patent application No. 2011-535161, dated Sep. 4, 2013.

(Continued)

*Primary Examiner* — Vernal Brown
(74) *Attorney, Agent, or Firm* — Koppel, Patrick, Heybl & Philpott

(57) ABSTRACT

A system for regulating access to a resource by a plurality of users is provided. The system comprises: a plurality of portable access keys, each being provided to one of the users and having an associated variable access parameter; an access barrier, having an open state allowing passage through and a closed state denying access to the resource, and defining an access queue; a sensor that determines an access queue characteristic related to a number of users in the access queue; a controller, which sets an access criterion based on the determined access queue characteristic; and a detector, located at the access barrier and which determines the variable access parameter of a portable access key when it is brought into the vicinity of the detector. The controller sets the access barrier in its open state if the variable access parameter determined by the detector meets the access criterion.

42 Claims, 4 Drawing Sheets

(52) U.S. Cl.
CPC ..... *G07C 9/00119* (2013.01); *G07C 2011/02* (2013.01); *G07C 2011/04* (2013.01)

(58) Field of Classification Search
USPC ..... 340/5.21
See application file for complete search history.

(56) References Cited

U.S. PATENT DOCUMENTS

| | | | | |
|---|---|---|---|---|
| 2007/0168390 | A1* | 7/2007 | Mardirossian | 707/104.1 |
| 2009/0313062 | A1 | 12/2009 | Natsuyama et al. | |

FOREIGN PATENT DOCUMENTS

| | | |
|---|---|---|
| JP | 2002123731 | 4/2002 |
| JP | 2005189921 | 7/2005 |
| JP | 2007011904 | 1/2007 |
| WO | WO 2008037952 A1 | 4/2008 |

OTHER PUBLICATIONS

International Search Report for Patent Appl. No. PCT/GB2009/002640, dated Dec. 14, 2009.
Office Action from corresponding Japanese Patent Appl. No. 2011-535161, dated May 9, 2014.

* cited by examiner

SYSTEM FOR REGULATING ACCESS TO A RESOURCE

TECHNICAL FIELD

This invention relates to a system and method for regulating access to a resource, such as an attraction, ride, show or event, as may be found in an amusement park.

BACKGROUND TO THE INVENTION

An amusement park comprises a number of attractions, for example, rides, shows and displays. Each attraction has a limited capacity for people to gain access to it at any specific time. For instance, a ride has only a certain number of seats. It is desirable that access be managed to use the attraction as efficiently as possible and that any regulation of access should be deemed as fair to all users. When more people wish to access the attraction than its instantaneous capacity allows, people who are unable to gain access immediately can be queued.

Physical queue lines are a well known way to manage access. However, the most popular attractions tend to have longer queues for access than less popular attractions. Moreover, potential users of an attraction may become bored queuing in a line. Managing access to a resource efficiently whilst minimising the length of queue line is difficult.

An existing approach divides the people who wish to access the attraction into two groups. A first group of people is arranged into a physical queue at a first access point for the attraction. Each member of the second group of people is informed of an allotted time slot when they can access the attraction. In order to access the attraction, a member of the second group need only be physically present at a second access point for the attraction, at their allotted time slot. Examples of such approaches include U.S. Pat. No. 6,529,786 and US-A-2008/0080445, both of which share common inventors with the present invention. However, sophisticated communications and computational facilities can be required to optimally allocate time slots to the second group of people. Moreover, since the users are separated in two distinct groups, it is difficult to optimise allocation collectively for all users.

SUMMARY OF THE INVENTION

Against this background, the present invention provides a system for regulating access to a resource by a plurality of users, the system comprising: a plurality of portable access keys, each portable access key being provided to one of the plurality of users and having a variable access parameter associated therewith, each portable access key further allowing the respective user to indicate a desire for a number of people to access the resource; and a queue manager, arranged to set an access criterion for the resource, to determine that the variable access parameter for a portable access key for which a desire to access the resource has been indicated meets the access criterion, and in consequence, to allow the user of the portable access key to join an access queue, users in the access queue subsequently being provided access to the resource, the queue manager being further configured to determine a characteristic for the access queue, related to a number of users in the access queue; and wherein the queue manager is further configured to set the access criterion for the resource on the basis of a characteristic for the access queue.

Unlike existing systems, this system does not require a communications network to inform a user as to whether they are able to access a resource, since the queue manager only sets a criterion and not a specific time for access to the resource. As the variable access parameter changes, the user is able to compare it with the access criterion and thereby determine whether they are able to access the resource. The cost and complexity of the system is therefore reduced.

Since the access criterion is based on a parameter of the access queue, specifically relating to the number of users in the access queue, the access criterion can be set to adjust the number of users in the access queue accordingly. The efficiency of the system is therefore improved.

Advantageously, the system is configured to set the variable access parameter for each of the plurality of portable access keys independently from the characteristic for the access queue, in particular, the access queue length. This means that the access criterion controls access to the resource and the variable access parameter, which is specific to a portable access key, can be set without knowledge of this criterion. In this way, the access criterion can be adjusted independently from the variable access parameter.

In a preferred embodiment, the queue manager comprises: an access barrier, having an open state allowing passage through the access barrier towards the resource and a closed state denying access to the resource, the access barrier defining the access queue; a sensor, arranged to determine the access queue characteristic; a controller, arranged to set the access criterion based on the determined access queue characteristic; and a detector, located at the access barrier and adapted to determine the variable access parameter of a portable access key when the portable access key is brought into the vicinity of the detector, the user indicating a desire for a number of people to access the resource by bringing it into the vicinity of the detector. The controller is further arranged to set the access barrier in its open state if the variable access parameter determined by the detector meets the access criterion.

The access queue is therefore a physical queue. Preferably, the access queue characteristic is indicative of a waiting time of users in the access queue. The average waiting time can therefore be minimised, or set to any appropriate value, depending on other factors. For example, if it is raining and the access queue is uncovered, a short queue waiting time may be preferred.

The system preferably adjusts the variable access parameter associated with the detected portable access key if the access barrier is set to its open state. Advantageously, the portable access key is arranged to store the variable access parameter and is arranged to perform said adjustment.

In the preferred embodiment, each of the plurality of portable access keys comprises a portable module comprising: a memory, arranged to store the respective variable access parameter for the portable module; and a transmitter, arranged to transmit the variable access parameter associated with the portable module. The detector may then comprise a receiver arranged to receive the associated variable access parameter.

Preferably, the system also comprises an entrance barrier, the entrance barrier and access barrier defining the access queue. The sensor may then be arranged to measure the number of users in the access queue. In this case, the sensor may comprise an entrance barrier counter, arranged to count the number of users passing through the entrance barrier and thereby leaving the access queue. The entrance barrier counter may comprise an indicator arranged to be activated when a user passes through the entrance barrier. For example, the indicator may be a switch in a turnstile arrangement, or an optical identifier arranged to identify a person passing through the entrance barrier.

In systems of this type, the sensor may be arranged to measure the number of users in the access queue. This can be achieved by counting the number of users joining the access queue based on the number of times that the access barrier is set to its open state, and by counting the number of users leaving the access queue using the entrance barrier counter. Alternatively, this may be achieved by using a camera to count the number of users in the access queue. Using either approach, a waiting time can then be determined by dividing the number of users in the queue by a throughput for the resource.

In one embodiment, each of the plurality of portable access keys has an associated identifier, and the entrance barrier counter is arranged to count the number of users passing through the entrance barrier using a receiver arranged to receive the associated identifier from a portable access key. Moreover, the detector at the access barrier may comprise a receiver arranged to receive the identifier, and the controller may be further arranged to set the access barrier in its open state if the receiver of the detector receives an associated identifier and the variable access parameter determined by the detector meets the access criterion. Such a system allows the number of users in the access queue to be counted by wireless means at the access barrier and the entrance barrier.

In one embodiment, the entrance barrier may have an open state allowing passage through the entrance barrier and a closed state denying access to the resource. The entrance barrier may then comprise a receiver arranged to receive an identifier from a portable access key and be further arranged to be set in its open state if the identifier is received by the entrance barrier receiver.

In some embodiments, the sensor is arranged to determine the access queue characteristic by measuring the waiting time of at least one user in the access queue. This can be achieved by: determining a start time at which the access barrier was set to its open state for a particular unique identifier; determining an end time at which the entrance barrier was set to its open state for the same unique identifier; and establishing a waiting time by taking the difference between the start time and the end time.

In the preferred embodiment, each of the plurality of portable access keys has an associated unique identifier. When the access queue characteristic is indicative of a waiting time of users in the access queue, this allows the waiting time to be determined on the basis of the number of users in the access queue and a waiting time for an individual user. Advantageously, the waiting time may be determined on the basis of waiting time for a plurality of individual users. Optionally, the controller may be further arranged to set one or more of the access barrier or entrance barrier in its open state if the receiver of the detector receives the unique identifier.

In systems where an identifier is associated with each portable access key, each of the plurality of portable access keys preferably comprises a transmitter arranged to transmit the associated identifier.

Optionally, each of the plurality of portable access keys further comprises a receiver. The entrance barrier may further comprise a transmitter, arranged to transmit an acknowledgement identifier which indicates that the entrance barrier has received the identifier associated with the portable access key. The receiver in the portable access key may then be arranged to receive the acknowledgement identifier and the variable access parameter stored in the memory can then be adjusted accordingly.

In the preferred embodiment, the variable access parameter associated with the portable access key from which the identifier is received at the entrance barrier is adjusted. In this way, the variable access parameter is adjusted when the user gains access to the attraction, beneficially allowing the user to leave the access queue before accessing the attraction without penalty, if they wish.

Optionally, the sensor is arranged to determine a plurality of access queue characteristics, and the controller is arranged to set the access criterion based on the plurality of access queue characteristics.

In the preferred embodiment, the variable access parameter comprises a number. Then, for each of the plurality of portable access keys, the system is arranged to measure the time elapsed since the respective variable access parameter was changed and to increase the respective variable access parameter based on the measured time elapsed. The system is further arranged, for each of the plurality of portable access keys, to repeat at regular time intervals the step of measuring the time elapsed and increasing the respective variable access parameter. This functionality may optionally be provided in each of the plurality of portable modules.

In an embodiment, the variable access parameter comprises a number and the controller is arranged to set the access criterion by determining a threshold and to set the access barrier in its open state if the variable access parameter determined by the detector meets the threshold. Thus, the access criterion comprises a determination that the variable access parameter determined by the detector meets the threshold.

The present invention may also be found in a system for regulating access to a first resource and a second resource by a plurality of users, the system comprising: the system as described above in association with the first resource; a second access barrier, having an open state allowing passage through the second access barrier and a closed state denying access to the second resource, the access barrier defining a second access queue; a second sensor, arranged to determine a second access queue characteristic, the second access queue characteristic being related to a number of users in the second access queue; a second controller, arranged to set a second access criterion for the second access barrier based on the determined second access queue characteristic; and a second detector, located at the second access barrier and adapted to determine the variable access parameter of a portable access key when the portable access key is brought into the vicinity of the second detector. The second controller is further arranged to set the second access barrier in its open state if the variable access parameter determined by the second detector meets the second access criterion. It will be recognised that the second controller may be part of, connected to, or integral with the controller in association with the first resource. Alternatively, the second controller may comprise a separate software or hardware entity in comparison with the controller in association with the first resource.

Further benefits of the system will be apparent when access to more than one resource is regulated. For example, the waiting time of one resource can be traded off against the waiting time of another resource. This improves efficiency of access to resources with significant demand.

In an alternative embodiment, the access queue comprises a queue sequence and the queue manager comprises: a queue interface, adapted to determine that the variable access parameter for a portable access key for which a desire to access the resource has been indicated meets the access criterion, and consequently to register the portable access key in the queue sequence. The queue manager is further arranged to manage the queue sequence and to communicate to a portable access key that has been added to the queue sequence an indication of when it can access the resource.

In this case, the access queue to use the attraction is mostly virtual (in other words, electronic). This is implemented using a virtual buffer queue which leads to the allocation of time slots for individual users. Since this queue is managed electronically, the portable access key advantageously comprises a transceiver. The transceiver is beneficially adapted to receive the communication that provides an indication of when the portable access key can access the resource.

Advantageously, the system is configured to set the variable access parameter for each of the plurality of portable access keys independently from the queue sequence length. This means that the access criterion controls access to the resource and the variable access parameter, which is specific to a portable access key, can be set without knowledge of this criterion. In this way, the access criterion can be adjusted independently from the variable access parameter.

Optionally, the queue manager is configured to remove the registration of portable access keys from the front of the queue sequence at a rate that is based on a throughput rate for the resource. In this way, the virtual buffer queue is maintained to supply users to the resource at an optimal rate.

Preferably, the queue interface forms part of the portable access key. Consequently, the portable access key checks that the variable access parameter meets the access criterion. Additionally or alternatively, the portable access key comprises a transmitter configured to communicate the indication of a desire to the queue interface. A part or all of the queue interface may then form part of the queue manager.

In the preferred embodiment, the queue manager is further configured to store the indication of when a portable access key can access the resource. This allows the queue manager to confirm that the user or users of a portable access key are able to access the resource.

Beneficially, the variable access parameter associated with a portable access key is adjusted when the queue manager stores an indication of when the portable access key can access the resource. It is typically reduced on the basis of the access criterion, although when the variable access parameter is a number, it can be set to zero.

In some embodiments, the queue interface is arranged to register the portable access key at the back of the queue sequence and wherein the queue manager is further arranged to maintain the queue sequence and to remove the registration of portable access keys from the front of the queue sequence at a known rate. In other words, the queue manager maintains and administers a full electronic queue. This queue is deterministic in nature. In other words, the queue manger registers each portable access key's position in the virtual queue.

In alternative embodiments, the queue manager is further arranged to determine a waiting time for the resource, and to communicate the waiting time and access criterion to the portable access keys. The queue interface forms a part of each portable access key, the queue interface being further arranged to communicate the determination that the variable access parameter meets the access criterion to the queue manager as a registration, and then to determine a time for the user of the portable access key to access the resource on the basis of the waiting time received from the queue manager. The queue manager is further arranged to receive the registrations from the portable access keys, to determine the length of the queue sequence and the waiting time for the resource on the basis of the number of registrations received, and to set the access criterion for the resource on the basis of the number of users waiting to access the resource.

Here, no virtual queue is actually maintained by the queue manager. Instead, a statistical approximation of the virtual queue is used. The queue manager establishes how many users wish to join the virtual queue and appropriately selects the throughput for the virtual queue, that is the rate of departure from the front of the virtual queue. Then, the queue manager can estimate a length for the virtual queue and consequently a waiting time in the virtual queue. Each portable access key determines that it should join the virtual queue based on the received access criterion. Each portable access key then leaves the virtual queue based on the received waiting time. This reduces the communications requirements between the portable access keys and the queue manager and is therefore potentially more efficient in its communications infrastructure.

Preferably, the system further comprises: an access barrier, having an open state allowing passage through the access barrier and a closed state denying access to the resource; and a detector, located at the access barrier and adapted to identify a portable access key brought into the vicinity of the detector. The controller is then further arranged to set the access barrier in its open state if the queue manager or the portable access key has stored an indication that the portable access key identified by the detector can access the resource at the time of detection. This regulates access to the resource automatically.

Using the access barrier creates a physical buffer queue. This may be small and allows for variations in the timeliness with which users arrive. However, with a virtual buffer queue feeding in to the physical buffer queue, and users given a specific time slot, the physical buffer queue can be kept short under almost all conditions.

Optionally, each of the plurality of portable access keys comprises a portable module comprising a transmitter, arranged to transmit a unique identifier for the portable module. Then, the detector may comprise a receiver arranged to receive the transmitted unique identifier.

With the increasing ubiquity of Internet-enabled mobile telephones, the portable module may be any communications device, but particularly a mobile telephone. Such a telephone, with reliable communications to a server such as a queue manager, allows the server to potentially have complete knowledge about the status of every user and every resource. In particular, the mobile telephone can be arranged to operate specific software to interface with the queue manager.

In the preferred embodiment, the variable access parameter comprises a number. Then, for each of the plurality of portable access keys, the system is arranged to measure the time elapsed since the respective variable access parameter was changed and to increase the respective variable access parameter based on the measured time elapsed. In some embodiments, multiple users may be associated with a single portable access key. In this case, the system is optionally arranged to increase the variable access parameter for a portable access key based on the measured time elapsed and the number of users associated with the portable access key. Additionally or alternatively, the queue interface is arranged to set the access criterion by determining a threshold.

In another aspect, the present invention provides a system for regulating access to a first resource and a second resource by a plurality of users, the system comprising: a plurality of portable access keys, each portable access key being provided to one of the plurality of users and having a variable access parameter associated therewith, each portable access key further allowing the respective user to indicate a desire for a number of people to access the first resource or second resource; a first queue manager, arranged to set an access criterion for the resource; a first queue interface, adapted to determine that the variable access parameter for a portable access key for which a desire to access the first resource has been indicated meets the first access criterion, and consequently to register the portable access key in a first queue sequence; a second queue manager, arranged to set a second access criterion for the second resource; a second queue interface, adapted to determine that the variable access parameter for a portable access key for which a desire to access the second resource has been indicated meets the second access criterion, and consequently to register the portable access key in a second queue sequence. The first queue manager is further arranged to manage the first queue sequence and to communicate to a portable access key that has been added to the first queue sequence an indication of when it can access the resource. The first queue manager is further configured to set the first access criterion for the first resource on the basis of a length of the first queue sequence. The second queue manager is further arranged to manage the second queue sequence and to store an indication of when a portable access key that has been added to the second queue sequence can access the second resource. The second queue manager is further configured to set the second access criterion for the second resource on the basis of a length of the second queue sequence.

In a second aspect, an alternative method of regulating access to a resource by a plurality of users is provided. The alternative method comprises: defining a plurality of variable access parameters, each variable access parameter being associated with a respective user from the plurality of users; determining an access queue characteristic, the access queue characteristic relating to a number of users wishing to access the resource who are waiting in an access queue; and allowing a user from the plurality of users to access the resource if the variable access parameter for said user meets an access criterion, the access criterion being based on the determined access queue characteristic, to thereby regulate access to the resource. In an embodiment of this alternative method, the access queue is defined by an access barrier and the step of allowing a user to access the resource comprises opening the access barrier.

Advantageously, the method may also comprise setting the variable access parameter for each of the plurality of portable access keys independently from the characteristic for the access queue, in particular, the access queue length.

Preferably, the access queue is defined by an access barrier and the step of allowing a user to access the resource comprises opening the access barrier. This method may optionally further comprise adjusting the variable access parameter for a user passing through the opened access barrier.

In an alternative embodiment, the access queue is an electronic queue structure. The method may then further comprise: registering the user in the electronic queue structure if the variable access parameter for said user meets the access criterion; managing the electronic queue structure; and communicating to a portable access key that has been added to the queue sequence an indication of when it can access the resource.

In some embodiments, the step of managing the electronic queue structure comprises maintaining the electronic queue structure and removing the registration of portable access keys from the front of the electronic queue structure at a pre-determined rate. Beneficially, the step of removing the registration of portable access keys from the front of the queue sequence is at a rate that is based on a throughput rate for the resource. Preferably, the method further comprises adjusting the variable access parameter associated with a portable access key when an indication of when the portable access key can access the resource is stored.

In many embodiments, the variable access parameter comprises a number, and the method may further comprise: measuring, for each of the plurality of users, the time elapsed since their respective variable access parameter was changed; and increasing, the variable access parameter for each of the plurality of users, based on the respective measured time elapsed.

BRIEF DESCRIPTION OF THE DRAWINGS

The invention may be put into practice in various ways, a number of which will now be described by way of example only and with reference to the accompanying drawings in which.

DESCRIPTION OF PREFERRED EMBODIMENTS

Figure 1:
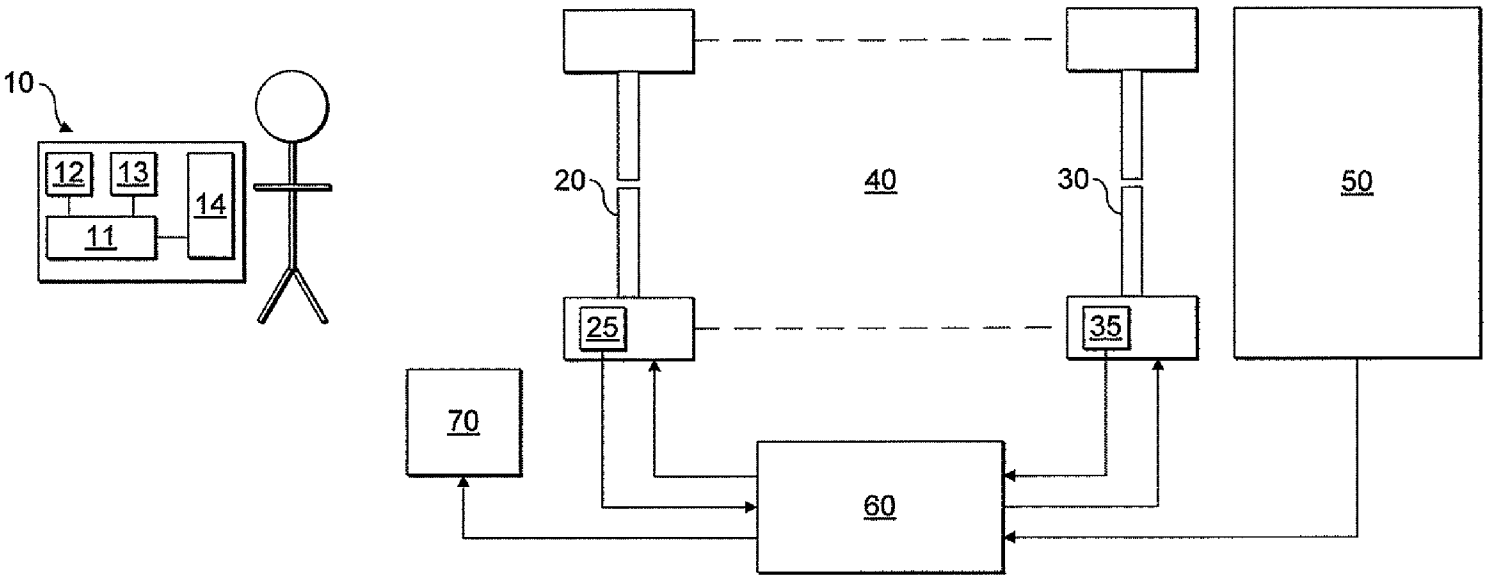
FIG. 1 shows a first embodiment of the present invention.

Referring first to FIG. 1, there is shown a first embodiment of the present invention. Each user is provided with a portable module 10. The user wishes to visit attraction 50. An access barrier 20 and an entrance barrier 30 are provided. The access barrier 20 and the entrance barrier 30 define an access queue 40. The access queue 40 can be further defined by other fences or barriers. Users wishing to use the attraction 50 must pass through access barrier 20 and entrance barrier 30 before reaching the attraction 50. The access barrier 20 has at least two states: a first, open state in which users can pass through the access barrier 20; and a second, closed state, in which the access barrier 20 prevents users from passing though. Similarly, the entrance barrier 30 has at least two states: a first, open state in which users can pass through the entrance barrier 30; and a second, closed state, in which the entrance barrier 30 prevents users from passing though.

The respective states of access barrier 20 and entrance barrier 30 are controlled by controller 60. The controller 60 can also be referred to as a queue manager. The access barrier 20 comprises first detector 25 and the entrance barrier 30 comprises second detector 35.

Each portable module 10 comprises a processor 11, a memory 12, a transceiver 13, and a display 14. The memory 12 stores the variable access parameter associated with that portable module 10. The display 14 is configured to display the variable access parameter, which is a number. The transceiver 13 transmits an identifier, which is unique to that portable module 10. The transmitter 13 also transmits the access parameter and number of users associated with the portable module 10.

The portable module processor 11 manages the variable access parameter, which is increased with increasing time. For instance, for each minute that the portable module processor is operative, the variable access parameter is increased by one unit.

When detector 25 receives the transmission of a unique identifier and a variable access parameter from a portable module 10, it passes this information to controller 60. Controller 60 compares the variable access parameter against an access criterion. If the access criterion is met, controller 60 then sets the access barrier 20 to its open state to allow the user carrying the portable module 10 to pass through. Controller 60 stores the unique identifier together with an associated indication of the time that the user entered the access queue 40. Once a sensor detects that the user has passed through, the access barrier 20 is closed again. If the access criterion is not met, the access barrier 20 is not opened and remains in its closed state.

A user passing through the access barrier 20 joins access queue 40. When the user reaches the entrance barrier 30 and if there is capacity available on the attraction, detector 35 receives the transmission of the unique identifier from the portable module 10. In response, it passes this information to the controller 60. Controller 60 stores an indication of the time that the user left the access queue 40 and associates this indication together with the unique identifier relating to that user.

Controller 60 is thereby able to determine the number of portable modules between the access barrier 20 and the entrance barrier 30 and therefore in the access queue 40.

This can be used to determine an estimated waiting time for users in the access queue 40. The throughput can be determined by analysing the number of users passing through the entrance barrier 30 over a predetermined time period. Then, a waiting time is calculated by dividing the number of people in the queue by the throughput. A waiting time determined in this way changes dynamically based on the current arrival rate and throughput in the access queue.

Over time, the probability of an error being introduced into the number of portable modules in the access queue 40 determined by the controller 60 increases. This occurs because of the possibility that the access barrier 20 or entrance barrier 30 register portable modules multiple times or not at all. Consequently, an error may also be introduced into the waiting time determined as described above (hereinafter referred to as a first waiting time).

An individual waiting time is also determined for each user, using the time difference between the stored indication of the time that the user entered the access queue 40 and the stored indication of the time that the user left the access queue 40. A waiting time determined in this way is specific to the user and relates to the waiting time that users experience when the user joined the access queue. This leads to a plurality of individual waiting times being established. A second waiting time may be determined by calculating an average of these plurality of individual waiting times. The second waiting time is also susceptible to errors, due to the possibility of different behaviour by different users in the access queue 40, which may skew this average.

This second waiting time can be compared with the first waiting time. A third waiting time can be set thereby, which is based on the first waiting time, adjusted on the basis of the difference between the first waiting time and the second waiting time. This third waiting time is used for setting the access criterion and thereby reduces the error in the determined waiting time and improves stable control of the access queue.

When the controller 60 determines the presence of a portable module 10, the portable module transceiver 13 receives a transmission from detector 25 that the entrance barrier 30 is opened, and in consequence, the portable module processor 11 reduces the variable access parameter to zero.

The entrance barrier 30 is opened when the attraction is available to accept new users. The entrance barrier 30 is set in a locked state by default, so that it cannot be set into an open state and no user can pass through and gain access to the attraction. When capacity on the attraction is available and the attraction is ready to receive users, the entrance barrier 30 is unlocked. Once unlocked, the entrance barrier will open when presented with a portable module 10, as explained above. When enough users have passed through to fill the capacity of the attraction, the entrance barrier 30 is again locked.

The controller 60 periodically sets the access criterion on the basis of the determined third waiting time for users in the access queue 40. The access criterion is a threshold, the level of which is set proportionately to the third waiting time. For example, if the waiting time increases, the threshold level is also increased. Conversely, the threshold level is reduced if the waiting time decreases.

In this way, long waiting times in the access queue 40 can be mitigated by reducing the number of users who are able to join the access queue 40. The access criterion, in the form of the threshold level, is displayed on public display 70. Public display 70 is provided with this information by controller 60. This informs users of the access criterion, which they can themselves compare with the variable access parameter displayed on display 14 of the portable module 10. The display 14 and public display 70 thereby prevents users from needing to test whether their variable access parameter meets the access criterion by using detector 25 at access barrier 20.

Figure 2A:
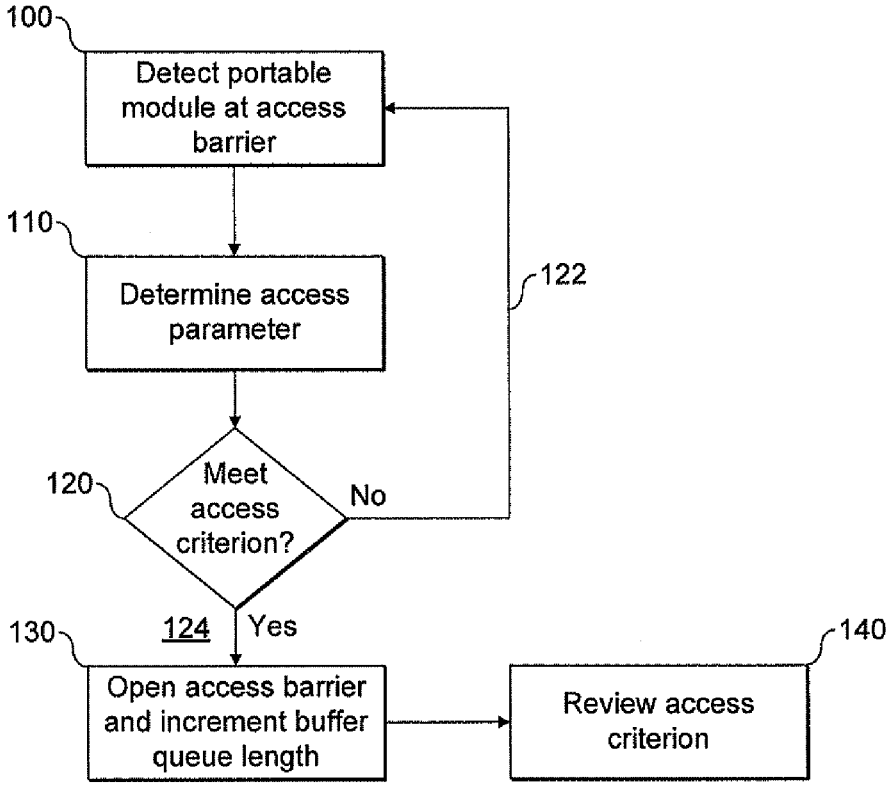
FIG. 2A shows a flowchart illustrating the operation of a processor in controlling an access barrier as shown in FIG. 1.

Referring now to FIG. 2A, there is shown a flowchart illustrating the operation of the controller 60 in controlling the access barrier 20. At step 100, a portable module is detected at access barrier 20. At step 110, the variable access parameter associated with the portable module is determined. At step 120, the variable access parameter is compared with the access criterion. If the access criterion is not met, path 122 is taken and the access barrier remains in its default, closed state. If the access criterion is met, path 124 is taken, leading to step 130. At this step, the access barrier is opened and the processor appropriately increments the stored number of users in access queue 40. Finally, at step 140, the access criterion is reviewed in view of the new access queue length and consequent new waiting time.

Figure 2B:
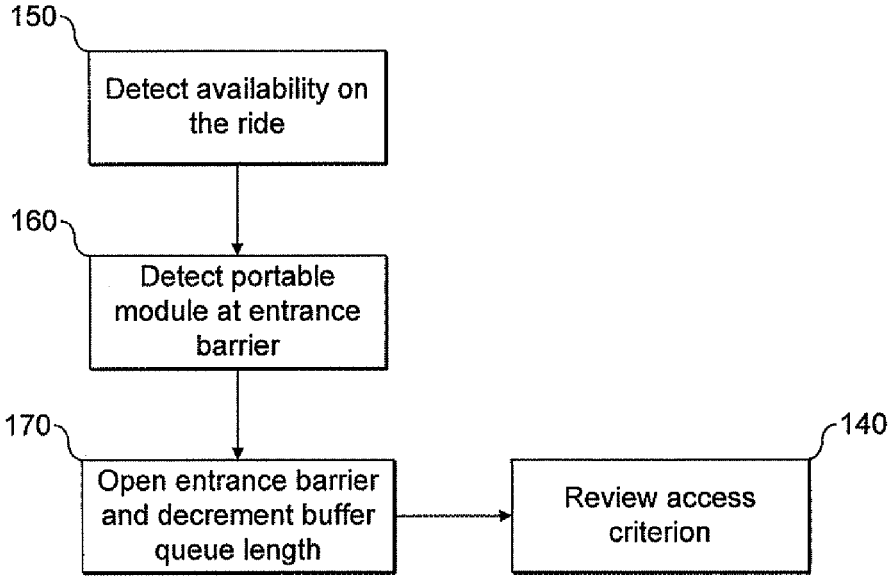
FIG. 2B shows a flowchart illustrating the operation of the processor in controlling an entrance barrier as shown in FIG. 1.

Referring next to FIG. 2B, there is shown a flowchart illustrating the operation of the processor 60 in controlling the entrance barrier 30. At step 150, availability on the attraction 50 is detected. If there is no availability on the attraction 50, then no users will be admitted to it. At step 160, a portable module is detected at entrance barrier 30. Any portable module detected at entrance barrier 30 is already within access queue 40. Then, entrance barrier 30 is set to its open state and the processor appropriately decrements the stored number of users in access queue 40. Finally, at step 140, the access criterion is reviewed in view of the new access queue length and consequent new waiting time.

Figure 3:
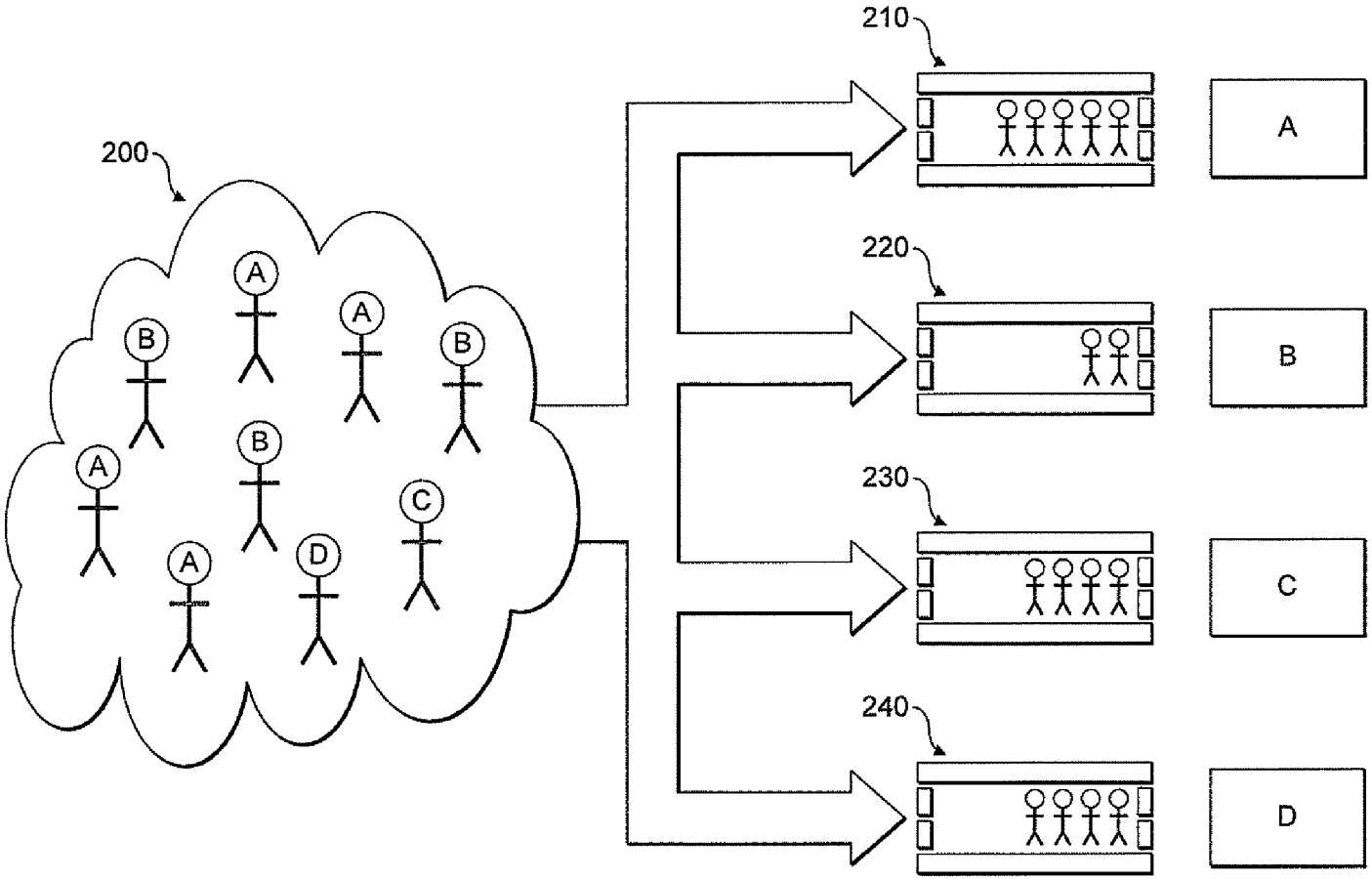
FIG. 3 shows a schematic diagram illustrating the system shown in FIG. 1 as applied to multiple attractions.

Referring now to FIG. 3, there is shown a schematic diagram illustrating the system shown in FIG. 1 as applied to multiple attractions, such as in an amusement park. A waiting area 200 is provided, which may be physically large. For example, waiting area 200 may include all public areas of an amusement park, including shops, restaurants, eating areas, etc. Users not using any of the attractions or waiting in any of the access queues wait here. Four attractions are shown: A, B, C and D. Attraction A is associated with first access queue 210. Attraction B is associated with second access queue 220. Attraction C is associated with third access queue 230, and attraction D is associated with fourth access queue 240.

For schematic purposes, the attraction that each user in the waiting area 200 will eventually access is indicated by the letter associated with that user. Although the attraction that the user will eventually access is indicated, each user does not provide any such indication to the system until the portable module associated with the user is brought into the vicinity of the access barrier 20 associated with that attraction. Whilst in the waiting area 200, the portable module associated with each user has a processor 11 which increases the variable access parameter associated with that portable module with time. When the user observes that the variable access parameter of their portable module meets the access criterion for the attraction that they wish to access, they go to the access barrier for the appropriate access queue.

The movement of users between attractions in a theme park is a type of queuing network. Rides, entrances, exits, and other attractions within the park are the nodes of this network. In queuing theory, this network is an example of a "Non-Jackson Network" (for example as defined in "Fundamentals of Queuing Theory", 3rd Edition, Gross & Harris, Section 4.6). It deviates from being a "Jackson Network" primarily because the routing probabilities are state dependent; the probability of choosing each attraction is significantly influenced by the queue length for that attraction, and to a lesser extent by the queue lengths for the other attractions.

In a typical amusement park, there can be tens of nodes, and thousands of possible users of the attractions at any one time. Using the analytical approach of writing a stochastic balance equation for each state of the network would lead to an extremely large number of equations. For practical purposes, the most effective way to analyse this network is by means of simulation on a digital computer. This allows the candidate control algorithm to be tested against various user behavioural models.

Whilst a preferred embodiment has been described above, the skilled person will recognise that the present invention can be implemented in a number of alternative ways. For example, although in the system above each user is provided with an individual portable module, alternatively, a group of users may be provided with a single portable module 10 and the portable module 10 stores the number of users associated with it in its memory 12. Then, the portable module can transmit this information to detector 25 and detector 35 as appropriate, such that the controller 60 is able to determine the number of users in the access queue 40.

The skilled person will understand that each portable access key need not have an associated unique identifier. Rather, multiple portable access keys may share a common identifier, which can be detected to cause the access barrier or entrance barrier or both to be set to its open state. The common identifier may be one or more of: a number; text; a data sequence; a code; an image; or a sound, and it may be detected using one or more of: wireless; audio; optical; or wired communication.

Alternatively, the portable access key need not have an associated identifier. Also, the entrance barrier need not have a closed state or an open state. Rather, the entrance barrier may comprise a counter which counts the number of people passing through the entrance barrier. Such a counter may be a switch in a turnstile arrangement, which identifies the event of a person passing through the entrance barrier. Alternatively, the counter may be an optical indicator, which identifies the event of a person passing through the entrance barrier. Other such counters to indicate that a person has passed through the entrance barrier will be apparent to the skilled person. It will be understood that although the variable access parameter is set to zero when the user passes through the entrance barrier 30, alternative approaches might be considered. For example, the variable access parameter may be reduced by the threshold level, or some other value. This value may be dependent on one or more of: the threshold level; the current time; the nature of the attraction; the weather; and the total number of users in the amusement park. Alternatively, the variable access parameter may be set to zero when the user passes through the access barrier 20. In some embodiments of the invention, an entrance barrier 30 may not be used or even required.

The skilled person will appreciate that other techniques may be considered for setting the access criterion based upon a waiting time for the users in the access queue described above. For example, although in the foregoing, the variable access parameter is described as a number and the access criterion a threshold, other implementations might be considered. For example, the variable access parameter may be a set of discrete levels and the access criterion may select one or more of these levels.

Advantageously, the waiting time relates only to the time duration spent by users from entry to the access queue until leaving the access queue. The skilled person will understand that although one means for determining a waiting time using the access barrier 20, and optionally the entrance barrier 30, has been described above, other techniques are possible. For example, only the first waiting time or only the second waiting time (as described above) may be used. The first waiting time may be determined using turnstiles to form the access barrier 20 and the entrance barrier 30 and by counting the number of times that each turnstile allows a user to pass through.

The second waiting time may be determined using a form of statistical analysis based on the plurality of individual waiting times, or by just selecting one individual waiting time. Alternatively, other methods of determining a waiting time may be employed.

For example, a camera may be used to obtain an image of at least part of the access queue and to determine a waiting time thereby. More than one such means may be used to provide further alternative values for the waiting time. For example, a camera may be used in addition to the technique described previously by counting passage through the access barrier 20 and optionally the entrance barrier 30.

A further example may use additional technology. If each portable module comprises position determining means, these may be used to report the location of the portable module within the access queue to a central server. The central server can thereby determine the number of portable modules in the access queue and a waiting time, thereby.

A combination of the two (or more) values obtained can then be used in determining the waiting time or setting the access criterion or both. Alternatively, one or more of the determined waiting times can be adjusted on the basis of a waiting time determined in a different way. This mitigates any problems due to errors in determination of the waiting time using a single method.

Although the throughput may be determined using the entrance barrier 30, alternatively the attraction 50 may have a determinable or known throughput.

The skilled person will recognise that the access criterion may be determined without the need to determine the waiting time, but rather on the basis of one or more parameters of the access queue, related to the number of users in the access queue. This may be termed an access queue characteristic. For example, the access criterion may be determined on the basis of the throughput of users through the access queue, the rate of arrival of users into the access queue, the total physical weight of the users in the access queue or the length of the occupied section of the access queue.

It will be understood that the access criterion may be set using other factors, in combination with an access queue characteristic. These could include one or more of: the number of users in the amusement park; the type of users; type of attractions; the specific attraction to which the access criterion relates; the attraction reliability; the physical characteristics of the user (for example, height or weight); the weather; the time and date; public and school holidays; tolerance parameters; and other variables that may influence user behaviour. The portable module may be configured to store additional information, such as physical characteristics. Some attractions have a height or weight restriction, which may form part of the access criterion.

Controllers based on queuing theory, or control system algorithms may be considered. For example, a proportional-integral-derivative controller (PID controller) might be considered. The optimum tuning for a PID controller will be dependent on the number of users in the amusement park. To take account of this, gain-scheduling may be employed, whereby a family of PID controllers is employed each tuned for a specific population range. Typical input constraints for a PID algorithm may include one or more of: that the threshold level should not be set below a specified minimum;

that the threshold level rate of increase should not exceed specified maxima; and that the threshold level rate of decrease should not exceed a specified maximum.

It may be desired to optimize the controller in other ways, such as to restrict the range and rate of change of the threshold level in the presence of various user behaviours. These behaviours could be due to external influences, random, or deliberate strategies on the part of the user.

The access criterion need not be based on just one waiting time for users in the access queue 40. The access criterion may be determined by considering multiple waiting times, for instance historical waiting times for that attraction, or current or historic waiting times for other attractions. In some cases, only historic waiting times may be used, such as a weighted average of previous waiting times over a specific time period. This could be useful, for instance, in mitigating effects from large groups of users desiring to access the attraction in an unpredictable manner and thereby causing the threshold level to change frequently. An example way to mitigate this effect may use a linear controller in the form of, or equivalent to, a weighted sum of past access queue waiting times and threshold levels. The controller may use other external variables to modify the threshold level, such as those described previously. Hysteresis of the threshold level might also be considered to further mitigate these effects.

Other alternatives include: a controller utilizing a combination of linear and non-linear techniques; a controller utilizing a combination of closed-loop and open-loop techniques. The controller may be implemented in many different ways, for example: as a mechanical device; as an analogue electronic device; or as a digital electronic device.

Either a central server or the portable module may count the number of attractions accessed. This allows for the option of a lower cost entry ticket with an entitlement to just a single attraction, a limited number of attractions or specific attractions.

Terminals may be provided at which users could use their portable modules to determine for which attractions their current variable access parameter would make them eligible. The terminal determines the variable access parameter associated with the portable module (in the same way as the access barrier) and identifies the access criterion for each attraction in the amusement park to provide an indication of the attractions for which the associated user is eligible. Such terminals may be combined with the standard attraction status displays, so that normally they show all the attraction thresholds (criteria). When a portable module is presented at the terminal they could then briefly highlight just the eligible attractions.

It is understood that the access barrier 20 and entrance barrier 30 may be set into their respective open and closed states in an automatic fashion, for example using electronic control with motors. Alternatively, the respective open and closed states may simply be indicated to an operator, who manually opens and closes the barrier accordingly.

A physical barrier, for either or both of the access barrier 20 and entrance barrier 30 need not be provided. An operator, a sign or another type of indicator can indicate whether access is provided (i.e. open) or denied (i.e. closed). This indication could be aural or visual, for example. In other words, the barrier need only comprise means to indicate an open or closed state.

Similarly, the access barrier 20 or the entrance barrier 30 need not be required to receive a unique identifier before opening. Rather, detection of a portable access key may be sufficient to trigger opening of the access barrier 20 or entrance barrier 30.

A further alternative is manual operation. An operator chooses a suitable threshold level on the basis of an access queue characteristic and informs the users by writing the threshold on a blackboard, or other equivalent method. Alternatively the users may be informed verbally.

In an alternative embodiment, the portable module processor 11 may have two modes: an initialisation mode; and a waiting mode. When the portable module processor 11 is in the initialisation mode, the variable access parameter is set to zero. This mode is used, for example, when the portable module is first given to a user. When the portable module processor 11 is in the waiting mode, the variable access parameter is increased with increasing time. For instance, for each minute that the portable module processor is operative, the variable access parameter is increased by one unit. This mode is used, for example, when the user wishes to use the attraction 50, but has not yet passed through the access barrier 20, or has exited from the entrance barrier 30. When the portable module transceiver 14 receives a transmission from detector 25 that the entrance barrier 30 is opened, the portable module processor 11 may be set to its initialisation mode to reduce the variable access parameter to zero. The portable module processor 11 is then set to its waiting mode.

In a further alternative embodiment, the portable module processor 11 may have three modes: an initialisation mode; a waiting mode; and an access mode. The initialisation mode and waiting mode are as described above. When the portable module processor is in the access mode, the variable access parameter is not increased. This mode may be used, for example, when the user has passed through the access barrier 20, but has not yet exited from the entrance barrier 30. When the access barrier 20 is opened, the portable module transceiver 13 receives a transmission from detector 25 to indicate this and in consequence, the portable module processor 11 is set to its access mode.

The skilled person will further understand that an alternative, but functionally equivalent variant of the present invention may be implemented using paper tickets instead of portable modules. Instead of each individual portable module storing the variable access parameter for the user, the paper ticket would simply provide an indication of the variable access parameter, allowing the user to identify the exact value of the variable access parameter for themselves. The following embodiment is an example of the way that such an approach could be implemented.

On arrival at the amusement park, each user is provided with a ticket indicating a time of issue and a barcode. The barcode represents the time of issue and indicates a unique identification code for the ticket. The variable access parameter for the user is defined by time difference (for example in minutes) between the current time from the time of issue for the ticket. A global timer is provided to provide a common reference point for both ticket issue times and the current time.

In common with the previously described embodiment, each user can pass through the access barrier of an access queue when the variable access parameter is at least at the threshold level for the attraction. The threshold level can be defined in time units, for example minutes. In practice, this can be communicated to the user in a simple way. The public display for each attraction shows a time earlier than the current time by an amount equal to the threshold level. The users can then understand that access to the attraction is available to them provided that the time on their ticket is no later than the time indicated on the public display.

On arriving at an access barrier for an attraction, the user provides their current ticket. The detector at the access barrier comprises a barcode reader which thereby detects the variable access parameter and unique identifier. If the access criterion is met, the barrier is then opened automatically. Alternatively, an operator could check each ticket and open the barrier manually.

The access barrier may comprise means to retain the ticket if the access barrier is opened. For instance, the ticket may need to be inserted into a slot for checking. Then, the entrance barrier may comprise a simple turnstile, which thereby identifies the number of users leaving the access queue. Alternatively, the entrance barrier may comprise a barcode reader to detect a ticket and then the entrance barrier would comprise means for retaining the ticket.

When the user exits the attraction, they are provided with a new ticket, in a similar way to the originally provided ticket, the new ticket indicating its time of issue. The new ticket could then be used in the same way as the originally provided ticket. The rest of the system would be identical to the previously described embodiment.

The skilled person would appreciate that instead of using the real time, other units may be used. For example, a global clock may be provided indicating an increasing number of time units, for example minutes, from the time at which the park opened. Tickets would then be issued with the value of the global clock at the time of issue. Alternatively, the global clock may be provided indicating a decreasing number of time units, for example minutes, until the time at which the park will close. Tickets would then be issued with the value of the global clock at the time of issue.

In an alternative embodiment, the access key provided to the user need not specifically indicate the variable access parameter. Instead, the access key may provide only a unique identifier; the variable access parameter associated with that access key is stored and updated in a central server. For example, each user may be provided with a wristband. Each wristband has an associated unique identifier, which is linked to a corresponding variable access parameter stored on the central server.

The wristband is provided with a barcode to indicate the associated unique identifier. Then, when arriving at an access barrier, the detector scans the barcode to receive the unique identifier and communicates with the central server in order to determine the corresponding variable access parameter. The user may determine their own variable access parameter by using a terminal which may be provided for that purpose, and which comprises a barcode reader and is able to communicate with the central server to determine the variable access parameter. In all other respects, the system is identical to any of the systems previously described, or variations or combinations thereof.

Although the use of a barcode for electronically providing the unique identifier has been discussed above, the skilled person will recognise that other electronic transmission means may alternatively be used, for example other optical recognition techniques, RFID, RF or optical transmitters.

Possible options for the portable access key may comprise a portable module, which may include a mobile or cellular telephone, portable digital assistant, an electronic watch. Such devices may be enabled to act as an access key when provided with suitable software in order to facilitate some of the features of the present invention. Alternatively, a badge, a ring, a wristband or device carried in a pocket could be employed. It will be recognised that some embodiments of the present invention require the portable access key to include electronic communication means, whilst other embodiments do not. Similarly, some embodiments of the present invention require the portable access key to include means readable by electronic systems, whilst other embodiments do not.

Advantageously, speed of operation is increased when either electronic communication means or means readable by electronic systems are available. Moreover, further features can be provided when either of these two technologies are provided. For example, these technologies may allow the portable access key to also provide other forms of access control, such as opening lockers, or electronic currency, as well as the features of the present invention.

A portable device could be an aid in location of a missing person such as a child. A supervisor or the missing person could flag the fact that they are lost to a central server, which may then cause an alarm to sound, for example if the missing person uses their portable module at an access barrier of an attraction. Additionally or alternatively, the portable modules of a group of users, for example children and parents, could be grouped so that no child is allowed to leave an amusement park or access an attraction without being accompanied by at least one parent from the group, and the last parent of the group to leave will be blocked if any children from the group remain in the amusement park.

Where the portable module includes reception means, the portable module may be able to provide other indicators to the user. For example, this may be used for reporting the access criterion for one or more attractions, problems with any attractions, advertising. The portable module may also include functionality to improve its operation. For instance, the portable module may include positioning determination means, such as GPS. This may be used for locating attractions and providing directions, as an example, or as an aid to finding a missing person.

Where the variable access parameter is a number, a transfer of quantity from a first portable module to a second portable module could be allowed. This may be limited to transfer within a defined group of portable modules (such as those of a family), or allowed for all portable modules. For instance, a couple, each with a variable access parameter of 30, could combine their variable access parameters, so that one of them would have a variable access parameter of 60 and the other a variable access parameter of zero. The user with the variable access parameter of 60 could then access any attraction with an access criterion threshold set at 60 or below, rather than 30 or below.

When designing an access barrier 20 and an associated access queuing area, it is important to provide enough capacity so that users having an associated variable access parameter that is sufficient to pass through the access barrier 20 are rarely or never blocked from doing so by other users. For example, if the access queuing area were to become full, and this prevented eligible users from entering the access area, it would probably lead to an uncontrolled queue forming before the access barrier 20. If this happened with any regularity, users would learn that there is an advantage to be gained by joining this uncontrolled queue before their variable access parameter met the access criterion. The duration of this queue could potentially grow to a similar extent to the physical queue. The skilled person will therefore recognise the advantages in providing sufficient space in the access queuing area to allow as many users to queue there as may be needed.

It is also desirable to prevent one user from obtaining multiple portable modules, and to block portable modules that have not been enabled for the current day from operation, so as to prevent one user obtaining an unfair advantage over other users.

Figure 4:
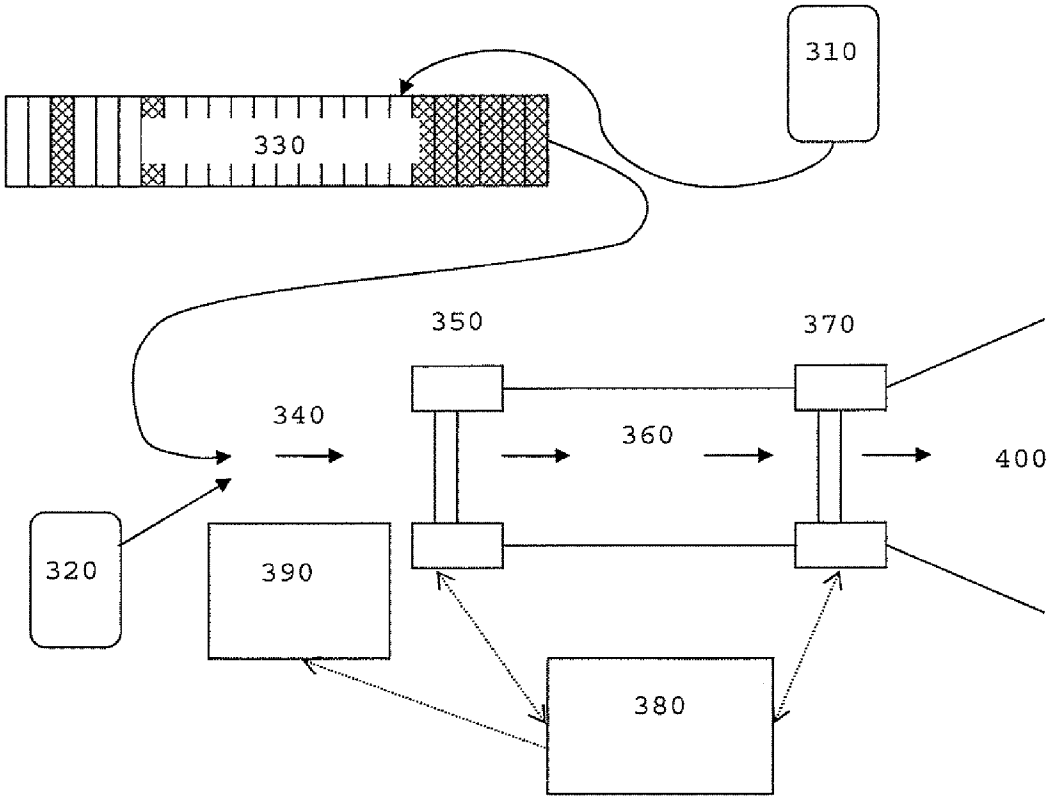
FIG. 4 shows a further embodiment according to the disclosure.

Referring now to FIG. 4, there is shown a schematic embodiment of a further embodiment according to the disclosure. This embodiment is similar to that shown in FIG. 1 above, but with some differences.

Each user is provided with either software for their own communication device 310, such as a mobile telephone, or a dedicated communication device 10 operating with appropriate software. In general, such a device can be referred to as a portable access key. The user wishes to visit attraction 400. In order to do so, the user will be processed in virtual queue 330. They will then arrive at entrance 340, pass through access barrier 350, physical queue 360 and entrance barrier 370. The system is controlled by queue manager 380, which interfaces with a public display 390.

Each communication device 310 comprises a processor, a memory, a transceiver, and a display. These are not shown in FIG. 4. The memory stores a variable access parameter associated with that communication device 310. The display is configured to display the variable access parameter, which is a number. The transceiver can transmit an identifier, which is unique to that communication device 310.

The processor of the communication device 310 manages the variable access parameter, which is increased with increasing time. For instance, for each minute that the portable module processor is operative, the variable access parameter is increased by one unit.

The communication device 310 also has functionality to allow the user to indicate a desire to use the attraction 400. The queue manager 380 sets an access criterion for the attraction 400. This is a threshold level. When the communication device 310 identifies that the associated variable access parameter meets the access criterion and a desire to use the attraction 400 has been received, it communicates this information as a reservation request to queue manager 380 using its transmitter.

Queue manager 380 then adds the communication device 310 to the back of the virtual queue 330. This is not a physical queue, but rather an abstract queue structure, stored electronically and managed by the queue manager 380. The queue manager removes a communication device 310 when it reaches the front of the virtual queue 330. The rate of removal is approximately the same as the throughput rate for the attraction 400.

When a communication device 310 reaches the front of the virtual queue 330, they are able to access the attraction 400. The queue manager 380 is programmed to assume that the throughput for the attraction 400 will remain constant for the period during which the communication device 310 is in the virtual queue 330. Hence, the queue manager 380 can predict the time at which the user of the communication device 310 will be able to access the attraction 400. Consequently, as soon as the communication device 310 joins the virtual queue 330, the queue manager 380 provides the communication device 310 with an estimated time slot for accessing the attraction 400. However, this estimated time slot can change as the communication device 310 is progressed through the virtual queue 330, due to changes in the ride throughput, such as those caused by breakdowns.

The user of the communication device 310 then arrives at entrance 340. A detector (not shown) detects the communication device 310. If the estimated time slot for the communication device 310 has arrived, the access barrier 350 is then opened. This allows the user or users of the communication device 310 to join the physical queue 360. The access barrier 350 is a turnstile. The physical queue 360 should be relatively short, since all the people waiting have been allocated a time slot by the queue manager 380 on the basis of the throughput rate for the attraction 400. On passing through the access barrier 350, the variable access parameter for the user's communication device 310 is reduced by the threshold level.

When the user or users reach the front of the physical queue 360, they pass through an entrance barrier 370 to the attraction 400. This is also a turnstile and is used to determine the throughput rate for the attraction 400.

The number of people in the physical queue 360 can be monitored in the same manner as described in relation to FIGS. 1 to 3 above. The total number of people who have passed through the entrance barrier 370 are subtracted from the total number who have passed through the access barrier 350. Then, a correction to this result is applied, determined by comparing the value of the count of people passing through entrance barrier 370 with the count of the number of people passing through access barrier 350 at the time when that user now passing through the entrance barrier 370 passed through the access barrier 350. If there have been no counting errors, then the two values should be equal. The use of a unique identifier in the communication device 310 is one method of identifying the number of users passing through the access barrier 350 and entrance barrier 370.

The throughput of the attraction 400 is monitored by measuring the average rate at which users pass through the entrance barrier 370. This rate is controlled by the operators of the attraction 400. However, this measured throughput will be an underestimate if the physical buffer queue 360 becomes empty. It is therefore desirable that the queue manager 380 regulates the flow of users from the virtual buffer queue 330 to the physical buffer queue 360 in order to avoid this condition. Of course, if the virtual buffer queue 330 becomes empty, then an empty buffer queue 360 may become inevitable. At the same time, the queue manager 380 can regulate the size of the physical buffer queue 360 so that it is no larger than is necessary to achieve this.

The queue manager 380 regulates the flow of users from the virtual buffer queue 330 to the physical buffer queue 360 by adjusting the throughput value used in the calculation of the slot times in the virtual buffer queue 330. This throughput value will be the same on average as the measured ride throughput. However, it may for periods be a little higher or a little lower as necessary in order to adjust the length of the physical buffer queue.

The entrance barrier 370 is opened when the attraction is available to accept new users. The entrance barrier 370 is set in a locked state by default, so that it cannot be set into an open state and no user can pass through and gain access to the attraction. When capacity on the attraction is available and the attraction is ready to receive users, the entrance barrier 370 is unlocked. When enough users have passed through to fill the capacity of the attraction, the entrance barrier 370 is again locked.

In this way, long waiting times in the access queue 360 can be mitigated by reducing the number of users who are able to join the access queue 360.

The queue manager 380 periodically sets the access criterion on the basis of the length of the virtual queue 330. This length is determined by the number of communication devices 310 in the virtual queue 330 and the number of users connected with each communication device 310. The access criterion is a threshold, the level of which is set on the basis of the length of the virtual queue 330. More specifically, the access criterion is a function of the current and past lengths of the virtual queue 330, and of the measured throughput for the attraction 400. Although it does not necessarily increase in response to an increase in the length of the virtual queue 330, an increase is the most likely response. For example, if the length of the virtual queue 330 increases, the threshold level is also increased. Conversely, the threshold level is reduced if the length of the virtual queue 330 decreases. This process of setting the threshold is the same as that described above with reference to FIGS. 1, 2*a* and 2*b*.

The queue manager 380 will regulate the threshold level (tariff) in order to keep the virtual buffer queue 330 as short as possible, but without becoming either empty (and thus underutilising the attraction's capacity), or causing excessively rapid or confusing (to the users) changes in the threshold.

The threshold is provided to the users of communication devices 310 by communication of this information using a wireless link from the queue manager 380. The access criterion is thereby notified to the users, which they can compare with the variable access parameter displayed on their communication device 310.

If the communication device 310 contains an RFID device, this may be used to identify the user at the access barrier 350 and entrance barrier 370. If not, alternate mechanisms include infra-red communications, a bar code displayed on the telephone, an access code to be typed in on a keypad, a coded sound burst played by the telephone, or an Internet message from the telephone.

The physical buffer queue 360 is regulated to avoid it growing to completely fill the available space. It is desirable that any user who is entitled to pass through the access barrier 350 can do so without being significantly impeded by other users.

This system can be extended for multiple attractions. Then, each communication device 310 accumulates its variable access parameter, and at this time, the user does not have to decide which attraction he is queuing for. After accumulating sufficient credits, the user makes a final selection of an attraction. They then join the virtual queue and are allocated a time slot. At the allocated time, the user arrives at the attraction, and joins a short physical access queue. The user reaches the front of the physical queue, and then enters the attraction.

From the perspective of a user with a communication device 310, they can run an application, which presents them with a display showing the current level of their variable access parameter, and the thresholds associated with each attraction. The current duration of the virtual buffer queue 330 for each attraction will also be displayed. They can choose to join the virtual buffer queue 330 for any attraction for which they have sufficient credits. This request will be sent to the server, which will then allocate to them the next available time slot in the virtual buffer queue 330 (or time slots if multiple users have been associated with that communication device 310).

Users could also have the option to reserve a slot that is later than the one selected above (this slot can of course only be selected from among those that are still available). The threshold level would be the same regardless of whether or not they take up this option. In other words, it would be the threshold level that applied at the time the reservation was made.

Communication devices 310 in the virtual buffer queue 330 will be allocated a time slot during which the respective user or users should join the physical buffer queue 360. The duration of these time slots will be set according to a desired throughput. This will sometimes lead to time slots with short durations of a minute or less. It may be unreasonable to expect users to be this precise in their arrival times. So the users will be given a time window surrounding their allocated time slot during which they may join the physical buffer queue.

One possible risk is that users could speculatively allocate a place for themselves in the virtual buffer queue 330, and then either cancel or not turn up during their allotted time slot. To deter this behaviour, the user could be subject to a reduction in their variable access parameter if they do either of these things.

The number of people associated with a communication device 310 is set at registration. Moreover, the user is able to use the communication device 310 to select the number of people who wish to access a particular attraction, provided that the number is less than or equal to the number of people registered with that communication device 310.

In practice, a single variable access parameter is associated with each portable access key. The rate of increase of that parameter with time would be independent of the number of associated people. In effect it would represent a combined single variable access parameter for all of the registered people for that portable access key. If not all of the people wished to access a particular attraction, the variable access parameter would still be reduced when any of the people associated with the portable access key use the attraction.

For those users without a suitable communication device 310, a portable module 320 can be provided. This is another form of portable access key, which will allow them to accumulate their variable access parameter and join the physical buffer queue 360 in the same manner as described above with reference to FIGS. 1, 2*a*, 2*b* and 3. The access criterion for these users, in the form of the threshold level, is displayed on public display 390. Public display 390 is provided with this information by queue manager 380.

The thresholds that they will see on the information displays 390 and which will apply to them, will also be set by the queue manager 380, but will be different to the thresholds shown on the communication device 310. This is because the queue manager 380 will adjust these thresholds on the basis of a characteristic of the physical buffer queue 360 and not the virtual buffer queue 330. Since these are different queues, they need to be regulated independently. In addition, the users with portable modules 320 will not be allocated places in the virtual buffer queue 330, so they would have a time advantage if the threshold levels were the same. The thresholds can be provided to the users of portable modules 320 using the public display 390.

The users of portable modules 320 will generally be provided with higher threshold levels (access criteria) than the users of communication devices 310. This would compensate for the fact that they can directly join the physical buffer queue 360 once their variable access parameter has reached a sufficient level, and will not have to pass through the virtual buffer queue 330.

In effect this system combines the virtual queue-based system described previously above with the system described with reference to FIGS. 1 to 3 above. Both systems share a common physical buffer queue 360.

There are a number of ways that the queue manager 380 could divide the available ride capacity between the users of portable modules 320 and the users of communication devices 310.

One method would be to divide the available ride capacity according to the proportions of users using the two types of device. So if 10% of the users were using portable modules 320, then 10% of the ride capacity could be allocated to these users. This could be achieved by using a nominal throughput of 90% of the measured ride capacity when allocating the time slots in the virtual buffer queue 30. The length of the physical buffer queue 360 could then be controlled by adjusting the threshold level for users of portable modules 20 in the manner described with reference to FIGS. 1 to 3 above.

Another method would be to set the threshold level for users of portable modules 320 to be equal to the threshold level for users of communication devices 310 plus the current wait time in the virtual buffer queue 330. Then, to regulate the length of the physical buffer queue 360, the rate of removal of communication devices 310 from virtual buffer queue 330 can be adjusted.

When regulating a limited resource, a queue serves two purposes. The first is to balance supply and demand, by increasing the cost to the customer to the point where the average supply exactly matches the average demand. This cost is in the form of time spent queuing. The second purpose is to ensure that the resource is kept fully utilized by providing a reservoir of customers.

A virtual queue reduces the time spent physically standing in line when queuing. However, existing virtual queues require a choice to be made about what resource to queue for in order to express demand for the resource.

In many cases, the size of queue required to balance supply and demand is much greater than that necessary to provide an adequate reservoir for the resource. Decoupling the time when customers start to queue for a resource and the time when they have to decide which resource they are queuing for is advantageous. The former must be set to balance supply and demand for the resource, whereas the latter only needs to be set to ensure an adequate reservoir of customers. By using a variable access parameter and access criterion, there is no link between the queuing time and the decision time, but a physical queue is still required to provide an adequate reservoir of customers.

The concept described above combines the idea of decoupling the time when customers start to queue and the time when they decide the resource they are queuing for with the idea of a virtual queue. This minimizes the time spent in a physical queue, and maximises the delay before the choice between resources must be made.

Whilst a preferred embodiment has been described above, the skilled person will recognise that the present invention can be implemented in a number of alternative ways. For example, the throughput rate for the attraction 400 can be set as equal to its capacity and not be based on the determination made at the entrance barrier 370.

Multiple service levels can be implemented by allowing different rates of accumulation for the variable access parameter in a communication device 310 or portable module 320. Users using the higher service level are allocated time slots in the same way as for other users. No users with allocated time slots would be pushed back.

Those users who know which attraction they are queuing for, could implement on their communication device 310 a feature that allows them to automatically reserve a time slot for them as soon as their variable access parameter meets the access criterion. The interface on their communication device 310 could be adapted specifically to provide this functionality. This prevents them from needing to check regularly if their variable access parameter meets the access criterion.

If a number of communication devices 310 become eligible to join the virtual queue 330 simultaneously, the server would allocate their places in the virtual queue in time-order of the communication devices 310 selecting this option. Not all of the communication devices 310 would necessarily be added to the virtual queue 330 at this time, because the threshold of the access criterion may increase as a result of the other communication devices 310 being added to the virtual queue 330.

If a communication device 310 has sufficient credits to cover the combined thresholds of two or more attractions, then they could be allowed to join the virtual queues 330 for these at the same time.

The queue manager 380 could ensure that the allocated slot times did not clash. If the slot times came in to conflict later on, due to delays in one or more of the attractions, the queue manager 380 could resolve these by moving the user to a later unoccupied slot for one of the attractions.

Users could use their communication devices 310 to select multiple attractions for automatic reservation. The queue manager 380 would allocate the communication device 310 to join the virtual queue 330 for each selected attraction in turn, once their variable access parameter met the respective access criterion for the attraction.

In another embodiment, the use of variable access parameters and access criteria could be hidden from the users.

They would just see the system as one where they select an attraction, and then after waiting for a period they are issued with a time slot to use the attraction.

To the user, such a system would appear similar to other virtual queuing systems. However, a benefit of this over a conventional virtual queue structure is that higher service levels may be used without causing explicit disruption. This is because the only users affected by the higher service level users pushing in are those who have not yet been allocated a time slot.

This system also allows a user to abandon one queue and join another without either wasting the time spent queuing, or explicitly disrupting the queues they are leaving or joining.

When multiple people are associated with a single portable access key, other optional features are possible. Each person associated with a portable access key could have their own individual variable access parameter. Moreover, these multiple variable access parameters could be lumped together. Then, the rate of increase of the combined variable access parameter with time would be proportional to the number of people registered for the portable access key. When requesting access to a ride, the threshold level for this group of people would then be the threshold level for a single person multiplied by the number of people wishing to access the attraction. Thus, if not all the people associated with the portable access key wished to access the attraction then the others could do so sooner.

Another alternative, is that the portable access key holds a separate independent variable access parameter for each associated user. In this case, for each ride reserved, the holder of the portable access key would specify the members of their group who wished to ride. The individual variable access parameter for each member would determine their individual entitlement to ride, and if they were entitled, be modified accordingly.

A further alternative implementation could replace the deterministic allocation of time slots to communication devices 310 in the virtual queue 330 with a statistical approach.

Such an approach to virtual queuing is described in US-A-2008/0080445, which shares common inventors with the present invention. As with the system described there, the queue manager 380 broadcasts to the communication devices 310 the current length of the virtual queue 330 and throughput for each attraction 400. It also broadcasts the threshold level of the access criterion for each attraction 400.

The communication device 310 would have a variable access parameter which accumulates as previously described and would also take over some of the functionality previously described in relation to the queue manager 380. For example, the communication device 310 would determine when its variable access parameter meets the threshold level for the queue of the desired attraction 400. At that stage, it determines that it should join a virtual queue, and communicates this to the queue manager 380. However, no virtual queue is actually maintained.

The queue manager 380 collects the aggregate data informing it of the number of users who have indicated a desire to access each attraction 400 and whose variable access parameters meet the access criterion. It uses this information to determine a statistical length for a virtual queue, but it does not need to store or manage such a virtual queue.

Instead, the communication device 310 has received the current length of virtual queue 330 as broadcast from the queue manager 380. This would provide the indication of when the user could access the attraction, but a specific time slot would be determined by the communication device 310 using this information.

The size of the physical buffer queue 360 would be regulated by altering the broadcast throughputs of the attractions. Each communication device currently in a virtual queue 330 would monitor the broadcast throughput of that queue, and each time it changed would recalculate the displayed time slot to reflect that change.

The physical buffer queue 360 and associated access barrier 350 and entrance barrier 370 would remain the same as described above.

This statistical system may not be as effective as the fully slotted system. Its benefit is that like the system described in US patent publication 2008/0080445, it can operate effectively in an environment with poor radio communications. Hence, it may not be optimal for a system where good communication links are available for the devices 310, but could be useful when using portable modules 320.

The invention claimed is:

1. A system for regulating access to a resource by a plurality of users, the system comprising:

a plurality of portable access keys, each portable access key being provided to one of the plurality of users and having a variable access parameter associated therewith, each portable access key further allowing the respective user to indicate a desire for a number of people to access the resource; and a queue manager, arranged to:

set an access criterion for the resource;

determine the variable access parameter for a portable access key for which a desire to access the resource has been indicated; and allow the user of the portable access key to join an access queue if the variable access parameter meets the access criterion, users being provided access to the resource from a front of the access queue as capacity becomes available on the resource, the queue manager being further configured to determine a characteristic for the access queue, related to a number of users in the access queue, and to set the access criterion for the resource, upon which basis a determination is made for allowing the user of the portable access key to join the access queue, on the basis of the characteristic for the access queue, dynamically affecting the rate at which users join the access queue thereby; and wherein, the access queue comprises a queue sequence and wherein the queue manager comprises:

a queue interface, adapted to determine that the variable access parameter for a portable access key for which a desire to access the resource has been indicated meets the access criterion, and consequently to register the portable access key in the queue sequence;

wherein queue manager is further configured to manage the queue sequence and to communicate to a portable access key that has been added to the queue sequence an indication of when it can access the resource, and wherein the variable access parameter associated with a portable access key is adjusted after the queue manager communicates an indication of when the portable access key can access the resource.

2. The system of claim 1, wherein the system is configured to set the variable access parameter for each of the plurality of portable access keys independently from the characteristic for the access queue.

3. The system of claim 1, wherein the queue manager comprises:

an access barrier, having an open state allowing passage through the access barrier towards the resource and a closed state denying access to the resource, the access barrier defining the access queue;

a sensor, arranged to determine the access queue characteristic;

a controller, arranged to set the access criterion based on the determined access queue characteristic; and a detector, located at the access barrier and adapted to determine the variable access parameter of a portable access key when the portable access key is brought into the vicinity of the detector, the user indicating a desire for a number of people to access the resource by bringing it into the vicinity of the detector; and wherein the controller is further arranged to set the access barrier in its open state if the variable access parameter determined by the detector meets the access criterion.

4. The system of claim 3, wherein the access queue characteristic is indicative of a waiting time of users in the access queue.

5. The system of claim 3, further arranged to adjust the variable access parameter associated with the detected portable access key if the access barrier is set to its open state.

6. The system of claim 3, wherein each of the plurality of portable access keys comprises a portable module comprising:

a memory, arranged to store the respective variable access parameter for the portable module; and a transmitter, arranged to transmit the variable access parameter associated with the portable module; and wherein the detector comprises a receiver arranged to receive the associated variable access parameter.

7. The system of claim 3, further comprising an entrance barrier, the entrance barrier and access barrier defining the access queue, and wherein the sensor is arranged to measure the number of users in the access queue.

8. The system of claim 7, wherein the sensor comprises:

an entrance barrier counter, arranged to count the number of users passing through the entrance barrier and thereby leaving the access queue.

9. The system of claim 8, wherein each of the plurality of portable access keys has an associated identifier;

wherein the entrance barrier counter is arranged to count the number of users passing through the entrance barrier using a receiver arranged to receive the associated identifier from a portable access key;

wherein the detector at the access barrier comprises a receiver arranged to receive said identifier; and wherein the controller is further arranged to set the access barrier in its open state if the receiver of the detector receives an associated identifier and the variable access parameter determined by the detector meets the access criterion.

10. The system of claim 9, further arranged to adjust the variable access parameter associated with the portable access key from which the associated identifier is received at the entrance barrier.

11. The system of claim 10, wherein each of the plurality of portable access keys comprises a transmitter arranged to transmit the associated identifier.

12. The system of claim 3, wherein the sensor is arranged to determine a plurality of access queue characteristics, and wherein the controller is arranged to set the access criterion based on the plurality of access queue characteristics.

13. The system of claim 3, wherein the variable access parameter comprises a number and wherein, for each of the plurality of portable access keys, the system is arranged to measure the time elapsed since the respective variable access parameter was changed and to increase the respective variable access parameter based on the measured time elapsed.

14. The system of claim 3, wherein the variable access parameter comprises a number and wherein the controller is arranged to set the access criterion by determining a threshold and to set the access barrier in its open state if the variable access parameter determined by the detector meets the threshold.

15. The system of claim 1, wherein the queue manager is configured to remove the registration of portable access keys from the front of the queue sequence at a rate that is based on a throughput rate for the resource.

16. The system of claim 1, wherein the queue interface forms part of the portable access key.

17. The system claim 1, wherein the portable access key further comprises a transmitter configured to communicate the indication of a desire to the queue interface.

18. The system claim 1, wherein the queue manager is further configured to store the indication of when a portable access key can access the resource.

19. The system of claim 1, wherein the queue interface is arranged to register the portable access key at the back of the queue sequence and wherein the queue manager is further arranged to maintain the queue sequence and to remove the registration of portable access keys from the front of the queue sequence at a known rate.

20. The system of claim 19:

wherein the queue manager is further arranged to determine a waiting time for the resource, and to communicate the waiting time and access criterion to the portable access keys;

wherein the queue interface forms a part of each portable access key, the queue interface being further arranged to communicate the determination that the variable access parameter meets the access criterion to the queue manager as a registration, and then to determine a time for the user of the portable access key to access the resource on the basis of the waiting time received from the queue manager; and wherein the queue manager is further arranged to receive the registrations from the portable access keys, to determine the length of the queue sequence and the waiting time for the resource on the basis of the number of registrations received, and to set the access criterion for the resource on the basis of the number of users waiting to access the resource.

21. The system of claim 1, further comprising:

an access barrier, having an open state allowing passage through the access barrier and a closed state denying access to the resource;

a detector, located at the access barrier and adapted to identify a portable access key brought into the vicinity of the detector;

wherein the controller is further arranged to set the access barrier in its open state if the queue manager or the portable access key has stored an indication that the portable access key identified by the detector can access the resource at the time of detection.

22. The system of claim 1, wherein each of the plurality of portable access keys comprises a portable module comprising a transmitter, arranged to transmit a unique identifier for the portable module, and wherein the detector comprises a receiver arranged to receive the transmitted unique identifier.

23. The system of claim 1, wherein the variable access parameter comprises a number and wherein, for each of the plurality of portable access keys, the system is arranged to measure the time elapsed since the respective variable access parameter was changed and to increase the respective variable access parameter based on the measured time elapsed.

24. The system of claim 1, wherein the variable access parameter comprises a number and wherein the queue interface is arranged to set the access criterion by determining a threshold.

25. A system for regulating access to a first resource and a second resource by a plurality of users, the system comprising:

a plurality of portable access keys, each portable access key being provided to one of the plurality of users and having a variable access parameter associated therewith;

a first access barrier, having an open state allowing passage through the access barrier and a closed state denying access to the first resource, the first access barrier defining a front of a first access queue;

a first sensor, arranged to determine a first access queue characteristic, related to a number of users in the first access queue;

a first controller, arranged to set a first access criterion for the first access barrier, upon which basis a determination is made for allowing the user of the portable access key to join the first access queue, based on the determined first access queue characteristic, dynamically affecting the rate at which users join the first access queue thereby; and a first detector, located at the first access barrier and adapted to determine the variable access parameter of a portable access key when the portable access key is brought into the vicinity of the first detector;

a second access barrier, having an open state allowing passage through the second access barrier and a closed state denying access to the second resource, the access barrier defining a front of a second access queue;

a second sensor, arranged to determine a second access queue characteristic, the second access queue characteristic being related to a number of users in the second access queue;

a second controller, arranged to set a second access criterion for the second access barrier based on the determined second access queue characteristic, dynamically affecting the rate at which users join the second access queue thereby; and a second detector, located at the second access barrier and adapted to determine the variable access parameter of a portable access key when the portable access key is brought into the vicinity of the second detector;

wherein the first controller is further arranged to set the first access barrier in its open state if the variable access parameter determined by the first detector meets the first access criterion as capacity becomes available on the first resource;

wherein the second controller is further arranged to set the second access barrier in its open state if the variable access parameter determined by the second detector meets the second access criterion as capacity becomes available on the second resource; and wherein the first access queue comprises a queue sequence and wherein the first controller comprises:

a queue interface, adapted to determine that the variable access parameter for a portable access key for which a desire to access the resource has been indicated meets the access criterion, and consequently to register the portable access key in the queue sequence;

wherein the first controller is further configured to manage the queue sequence and to communicate to a portable access key that has been added to the queue sequence an indication of when it can access the first resource, and wherein the variable access parameter associated with a portable access key is adjusted after the queue manager communicates an indication of when the portable access key can access the first resource.

26. A system for regulating access to a first resource and a second resource by a plurality of users, the system comprising:

a plurality of portable access keys, each portable access key being provided to one of the plurality of users and having a variable access parameter associated therewith, each portable access key further allowing the respective user to indicate a desire for a number of people to access the first resource or second resource;

a first queue manager, arranged to set an access criterion for the resource;

a first queue interface, adapted to determine that the variable access parameter for a portable access key for which a desire to access the first resource has been indicated meets the first access criterion as capacity becomes available on the first resource, and consequently to register the portable access key at the back of a first queue sequence;

a second queue manager, arranged to set a second access criterion for the second resource; and a second queue interface, adapted to determine that the variable access parameter for a portable access key for which a desire to access the second resource has been indicated meets the second access criterion as capacity becomes available on the second resource, and consequently to register the portable access key at the back of a second queue sequence;

wherein the first queue manager is further arranged to manage the first queue sequence and to communicate to a portable access key that has been added to the first queue sequence an indication of when it can access the resource, and to set the first access criterion for the first resource, upon which basis a determination is made for allowing the user of the portable access key to join the first queue sequence, on the basis of the length of the first queue sequence, dynamically affecting the rate at which users join the first queue sequence thereby;

wherein the first queue manager comprises:

a queue interface, adapted to determine that the variable access parameter for a portable access key for which a desire to access the resource has been indicated meets the access criterion, and consequently to register the portable access key in the first queue sequence;

wherein first queue manager is further configured to manage the first queue sequence and to communicate to a portable access key that has been added to the first queue sequence an indication of when it can access the resource, and wherein the variable access parameter associated with a portable access key is adjusted after the first queue manager communicates an indication of when the portable access key can access the resource;

wherein the second queue manager is further arranged to manage the second queue sequence and to communicate to a portable access key that has been added to the queue sequence an indication of when it can access the resource; and wherein the second queue manager is further configured to set the second access criterion for the second resource on the basis of a length of the second queue sequence, dynamically affecting the rate at which users join the second queue sequence thereby.

27. A method of regulating access to a resource by a plurality of users, the method comprising:

defining a plurality of variable access parameters, each variable access parameter being associated with a respective user from the plurality of users;

determining an access queue characteristic, the access queue characteristic relating to a number of users wishing to access the resource who are waiting in an access queue;

determining that a variable access parameter of the respective user for which a desire to access the resource has been indicated meets the access queue characteristic, and registering the portable access key in a queue sequence of the access queue;

communicating to a portable access key that has been added to the queue sequence an indication of when it can access the resource, wherein the variable access parameter associated with a portable access key is adjusted after communicating the indication; and allowing a user from the plurality of users to access the resource if the variable access parameter for said user meets an access criterion, upon which basis a determination is made for allowing the user to join the access queue, users being provided access to the resource from a front of the access queue as capacity becomes available on the resource, the access criterion being based on the determined access queue characteristic, to regulate access to the resource and dynamically affect the rate at which users join the access queue thereby.

28. The method of claim 27, wherein the access queue is defined by an access barrier and wherein the step of allowing a user to access the resource comprises opening the access barrier.

29. The method of claim 28, further comprising:

adjusting the variable access parameter for a user passing through the opened access barrier.

30. The method of claim 27, wherein the variable access parameter comprises a number, the method further comprising:

measuring, for each of the plurality of users, the time elapsed since their respective variable access parameter was changed; and increasing, the variable access parameter for each of the plurality of users, based on the respective measured time elapsed.

31. The method of claim 27, wherein the access queue is an electronic queue structure, the method further comprising:

registering the user in the electronic queue structure if the variable access parameter for said user meets the access criterion;

managing the electronic queue structure; and communicating to a portable access key that has been added to the queue sequence an indication of when it can access the resource.

32. A method for regulating access to a resource by a plurality of users, the method comprising:

providing a portable access key to each of the plurality of users, each portable module having a variable access parameter associated therewith;

defining a front of an access queue using an access barrier;

closing the access barrier so as to deny access to the resource;

determining an access queue characteristic, the access queue characteristic being related to a number of users in the access queue;

setting an access criterion for the access barrier, upon which basis a determination is made for allowing the user of the portable access key to join the access queue, based on the determined access queue characteristic, dynamically affecting the rate at which users join the access queue thereby;

determining the variable access parameter of a portable access key when the portable access key is brought into the vicinity of a detector in the access barrier;

communicating to a portable access key an indication that it can access the resource, wherein the variable access parameter associated with a portable access key is adjusted after communicating the indication; and opening the access barrier, to allow passage through the access barrier, if the variable access parameter determined by the detector meets the access criterion as capacity becomes available on the resource.

33. The method of claim 32, further comprising:

adjusting the variable access parameter for a user passing through the opened access barrier.

34. The method of claim 32, wherein the variable access parameter comprises a number, the method further comprising:

measuring, for each of the plurality of users, the time elapsed since their respective variable access parameter was changed; and increasing, the variable access parameter for each of the plurality of users, based on the respective measured time elapsed.

35. A method for regulating access to a resource by a plurality of users, the method comprising:

providing a portable access key to each of the plurality of users, each portable access key having a variable access parameter associated therewith;

receiving and storing an indication from a user of a desire for a number of people to access the resource using the portable access key;

setting an access criterion for the resource;

determining that the variable access parameter for a portable access key for which a desire to access the resource has been indicated meets the access criterion, and consequently registering the portable access key in a queue sequence;

managing the queue sequence; and communicating to a portable access key that has been added to a front of the queue sequence an indication of when it can access the resource as capacity becomes available on the resource, wherein the variable access parameter associated with a portable access key is adjusted after communicating the indication; and wherein the access criterion is set for the resource, upon which basis a determination is made for allowing the user of the portable access key to join the queue sequence, on the basis of the length of the queue sequence, dynamically affecting the rate at which users join the queue sequence thereby.

36. The method of claim 35, wherein the variable access parameter is set for each of the plurality of portable access keys independently from the queue sequence length.

37. The method of claim 35, wherein the step of registering the portable access key in a queue sequence comprises registering the portable access key at the back of the queue sequence, wherein managing the queue sequence comprises maintaining the queue sequence, the method further comprising:

removing the registration of portable access keys from the front of the queue sequence at a known rate.

38. The method of claim 37, wherein the step of removing the registration of portable access keys from the front of the queue sequence is at a rate that is based on a throughput rate for the resource.

39. The method of claim 35, wherein the step of determining is carried out at each portable access key, the method further comprising:

determining a waiting time for the resource in a queue manager, and communicating the waiting time and the access criterion from the queue manager to the portable access keys;

communicating the determination that the variable access parameter meets the access criterion from the portable access key to the queue manager as a registration;

receiving the registrations from the portable access keys at the queue manager;

determining the length of the queue sequence and the waiting time for the resource at the queue manager on the basis of the number of registrations received;

setting the access criterion for the resource on the basis of the number of users waiting to access the resource; and determining, at the portable access key, a time for its user to access the resource, on the basis of the waiting time received from the queue manager.

40. The method of claim 35, further comprising adjusting the variable access parameter associated with a portable access key when an indication of when the portable access key can access the resource is stored.

41. The method of claim 35, wherein the variable access parameter comprises a number, the method further comprising:

measuring, for each of the plurality of users, the time elapsed since their respective variable access parameter was changed; and increasing, the variable access parameter for each of the plurality of users, based on the respective measured time elapsed.

42. The method of claim 35, wherein the variable access parameter comprises a number and wherein the access criterion is set by determining a threshold.

* * * * *